US009926640B2

(12) United States Patent
Miura et al.

(10) Patent No.: US 9,926,640 B2
(45) Date of Patent: Mar. 27, 2018

(54) ELECTROPLATING CELL, AND METHOD OF FORMING METAL COATING

(71) Applicant: TOYOTA JIDOSHA KABUSHIKI KAISHA, Toyota-shi, Aichi-ken (JP)

(72) Inventors: Fusayoshi Miura, Nagakute (JP); Atsushi Murase, Nagakute (JP); Naoki Hasegawa, Nagakute (JP); Motoki Hiraoka, Toyota (JP); Yuki Sato, Nagakute (JP)

(73) Assignee: TOYOTA JIDOSHA KABUSHIKI KAISHA, Toyota-Shi, Aichi-ken (JP)

( * ) Notice: Subject to any disclaimer, the term of this patent is extended or adjusted under 35 U.S.C. 154(b) by 276 days.

(21) Appl. No.: 14/713,549

(22) Filed: May 15, 2015

(65) Prior Publication Data

US 2015/0329982 A1 Nov. 19, 2015

(30) Foreign Application Priority Data

May 19, 2014 (JP) ..... 2014-103394

(51) Int. Cl.

*C25D 17/00* (2006.01)
*C25D 7/06* (2006.01)
*C25D 3/12* (2006.01)

(52) U.S. Cl.

CPC ..... *C25D 17/002* (2013.01); *C25D 7/0607* (2013.01); *C25D 3/12* (2013.01)

(58) Field of Classification Search

CPC ..... C25D 17/002
USPC ..... 204/295–296
See application file for complete search history.

(56) References Cited

U.S. PATENT DOCUMENTS

| | | | | |
|---|---|---|---|---|
| 4,176,215 | A * | 11/1979 | Molnar | C08J 5/2237 204/252 |
| 4,909,913 | A | 3/1990 | Fukuda et al. | |
| 2005/0051437 | A1* | 3/2005 | Kurashina | H01L 21/2885 205/143 |
| 2015/0014178 | A1 | 1/2015 | Hiraoka et al. | |

FOREIGN PATENT DOCUMENTS

| | | | |
|---|---|---|---|
| CN | 1816650 | A | 8/2006 |
| DE | 102007060200 | A1 | 6/2009 |
| EP | 2905361 | A1 | 8/2015 |
| JP | 53-132069 | A | 11/1978 |
| JP | 2005-248319 | A | 9/2005 |

(Continued)

OTHER PUBLICATIONS

Hiroyuki Sugimura et al.: Activation of Cyclo-Olefine Polymer Surface for the Promotion of Palladium Adsorption Based on the Oxygen-Amprified Vacuum Ultra-Violet Process, pp. 662-668, vol. 64, No. 12, 2013.

(Continued)

*Primary Examiner* — Brian W Cohen
(74) *Attorney, Agent, or Firm* — Sughrue Mion, PLLC

(57) ABSTRACT

An electroplating cell includes: an anode chamber in which an anode chamber solution is stored; and a separator that separates the anode chamber and a cathode. The electroplating cell undergoes a modification treatment of introducing a carboxylic acid group or a derivative thereof into a base material of the separator. The separator selectively allows permeation of metal ions contained in the anode chamber solution.

4 Claims, 3 Drawing Sheets

(56) References Cited

FOREIGN PATENT DOCUMENTS

| | | | |
|---|---|---|---|
| JP | 2007-505996 | A | 3/2007 |
| JP | 2012-219362 | A | 11/2012 |
| WO | 2005/007933 | A1 | 1/2005 |
| WO | 2005/028717 | A1 | 3/2005 |
| WO | 2013/125643 | A1 | 8/2013 |

OTHER PUBLICATIONS

Shigeo Hoshino et al.: "Limiting Current Density in Nickel Plating—Studies on High Speed Electrodeposition (Part 1)", pp. 263-268, vol. 23, No. 5, 1972.

* cited by examiner

ELECTROPLATING CELL, AND METHOD OF FORMING METAL COATING

INCORPORATION BY REFERENCE

The disclosure of Japanese Patent Application No. 2014-103394 filed on May 19, 2014 including the specification, drawings and abstract is incorporated herein by reference in its entirety.

BACKGROUND OF THE INVENTION

1. Field of the Invention

The present invention relates to an electroplating cell, and a method of forming a metal coating, and more specifically relates to an electroplating cell which is capable of easily forming a metal coating on a surface of a cathode (plated object), and a method of forming a metal coating using the electroplating cell.

2. Description of Related Art

A technique of forming a pattern formed of a metal coating (hereinafter, referred to as "metal pattern") on a conductive substrate with a simple method is required. A technique of masking a portion other than a metal pattern to perform wet electroplating is most commonly used. However, in this technique, a mask forming step and a mask removing step are required, and there is a problem in that the cost for the management and waste liquid treatment of a plating solution is high. Recently, a method of forming a metal coating with a "physical method" such as physical vapor deposition or sputtering not having the above-described problem and then removing a masking portion has been adopted. However, in this method of physically forming a metal coating, a film forming speed is generally slow, and a vacuum unit is necessary. Therefore, it is difficult to say that a system using this method is an economical high-speed production system.

On the other hand, as another method in which masking is not necessary, a method of coating a substrate with an ink, in which conductive fine powder and a binder are mixed, using a "printing method" such as screen printing or an ink jet and then removing the binder by firing has also been adopted. However, with this "printing method", it is difficult to form a circuit having low volume resistivity even if a volatile or sublimable binder is used.

However, recently, as an attempt during electroplating to prevent electrodeposition at a portion other than a target portion and to form a circuit without masking, a gel electrolyte (Japanese Patent Application Publication No. 2005-248319 (JP 2005-248319 A)) and a cation exchange membrane (Japanese Patent Application Publication No. 2012-219362 (JP 2012-219362 A) and International Publication WO 2013/125643) have been proposed.

When such a separator is used, a current density of approximately 10 mA/cm$^2$ is obtained at room temperature, for example, in Cu plating in which electrodeposition from an aqueous solution is relatively easy. However, in order to perform a film forming process (high current density electrodeposition) at a higher speed than that of the Cu plating, it is necessary to take an action, for example, to increase a metal ion concentration or to increase the temperature. Therefore, a higher cost is required. In particular, it is difficult to electrodeposit metal (for example, metal in which deposition potential of nickel ions, zinc ions, tin ions, or the like is low), in which an electrodeposition reaction (reduction deposition reaction) competes with a hydrogen ion discharge reaction (hydrogen evolution reaction), from an acidic or slightly acidic aqueous solution having a high hydrogen ion concentration using a separator.

The details of the reason for this phenomenon are unclear, but it is considered that this phenomenon is caused by the following reasons (1) to (3).

(1) Hydrogen is produced at an electrodeposition portion, and defects (voids) are formed.

(2) Due to deposition over voltage being too low, metal is electroplated in a fine powder form or in a lump, and when the electrodeposition is performed in a state where a separator and a cathode are in close contact with each other, an electrodeposit infiltrates into the separator.

(3) Due to a pH increase at a cathode interface caused by hydrogen production, a hydroxide is produced at an electrodeposition portion, and passivation (increase in bath voltage) progresses.

During electrodeposition using an insoluble anode and a separator, hydrogen ions produced from an anode chamber solution are blocked due to the presence of the separator, and thus the pH at a cathode interface is likely to increase. Therefore, the above-described problems are particularly severe. In particular, in an electroplating cell (not containing a cathode chamber solution) in which a separator and a cathode are in close contact with each other, or in an electroplating cell in which the amount of a cathode chamber solution is extremely small, even the amount of hydrogen produced by hydrogen evolution reaction is extremely small, it is difficult to perform normal electrodeposition due to the effects of (1) and (2) described above.

SUMMARY OF THE INVENTION

The invention has been made to provide an electroplating cell which is capable of easily forming a metal coating; and a method of forming a metal coating using the electroplating cell. The invention has been made to provide an electroplating cell which is capable of electrodepositing a pattern without masking using a plating solution containing metal ions in which hydrogen production is likely to occur; and a method of forming a metal coating using the electroplating cell.

According to a first aspect of the invention, there is provided an electroplating cell including: an anode chamber in which an anode chamber solution is stored; and a separator that separates the anode chamber and a cathode from each other. The electroplating cell undergoes a modification treatment of introducing a carboxylic acid group or a derivative thereof into a base material of the separator. The separator selectively allows permeation of metal ions contained in the anode chamber solution.

According to a second aspect of the invention, there is provided a method of forming a metal coating including: forming a metal coating on a surface of the cathode using the electroplating cell according to the first aspect.

The separator undergoes a modification treatment of introducing a carboxylic acid group or a derivative thereof to a base material. Therefore, even when a plating solution is used containing metal ions in which hydrogen production is likely to occur, a pattern can be electrodeposited without masking. In addition, in order to prevent the deposition of a hydroxide, it is not necessary to decrease the metal ion concentration in the plating solution. Therefore, a metal coating can be formed at a high rate.

The reason is considered to be as follows.

(1) The precipitation of a metal hydroxide is prevented (due to the carboxylic acid group, a complexation stabilizing action and an acidifying action are obtained).

(2) The metal ion transport number is increased (a neutral void portion in the separator is blocked, and an acid group is introduced).

(3) The cathode reaction is prevented (due to metal adsorption on the surface, hydrogen production occurs, and an action of inhibiting the growth of coarse crystals is obtained).

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

[1. Electroplating Cell 10]

Figure 1:
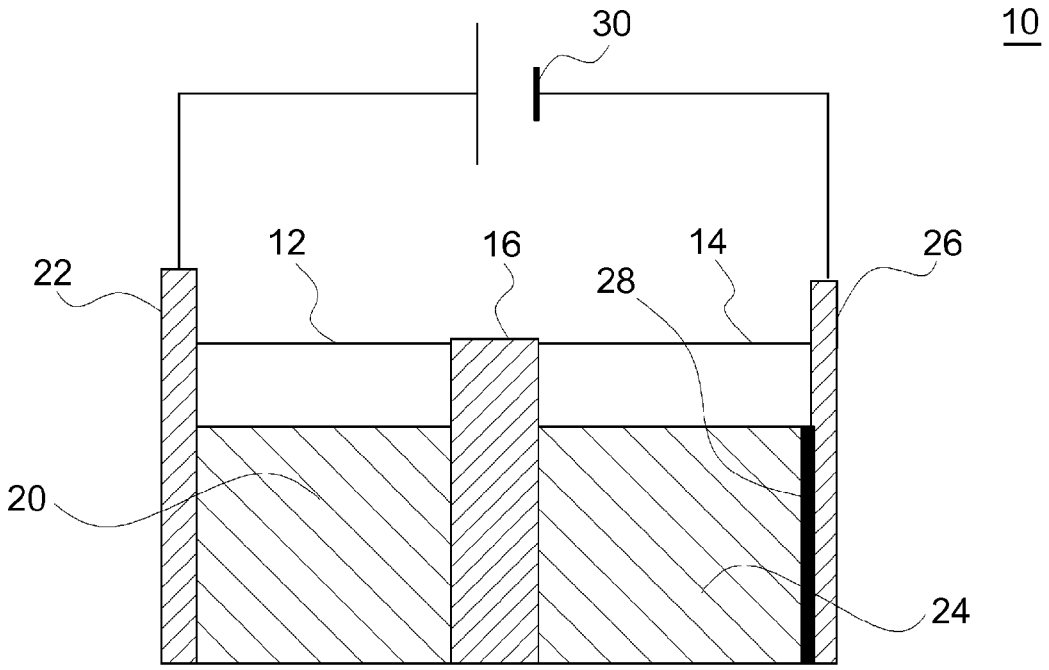
FIG. 1 is a schematic diagram illustrating an electroplating cell according to a first embodiment of the invention.

FIG. 1 is a schematic diagram illustrating an electroplating cell according to a first embodiment of the invention. In FIG. 1, an electroplating cell 10 includes an anode chamber 12, a cathode chamber 14, and a separator 16. The anode chamber 12 is filled with an anode chamber solution 20, and an anode 22 is dipped in the anode chamber solution 20. Further, the anode 22 is connected to a positive pole of a power supply 30. The cathode chamber 14 is filled with a cathode chamber solution 24, and a cathode 26 is dipped in the cathode chamber solution 24. Further, the cathode 26 is connected to a negative pole of the power supply 30. When plating is performed using this electroplating cell 10, a metal coating 28 is deposited on a surface of the cathode 26.

[1.1. Anode Chamber]

In the anode chamber 12, the anode chamber solution 20 is stored. The size and shape of the anode chamber 12, the material constituting the anode chamber 12, and the like are not particularly limited, and the optimum ones according to the purpose can be selected.

[1.2. Anode Chamber Solution]

The anode chamber 12 is filled with the anode chamber solution 20 having a predetermined composition. The details of the anode chamber solution 20 will be described below. The amount of the anode chamber solution 20 filling the anode chamber 12 is not particularly limited, and the optimum amount according to the purpose can be selected.

[1.3. Anode]

The anode 22 is not particularly limited as long as at least a surface thereof is formed of a conductive material. The entire portion or only a surface of the anode 22 may be formed of a conductive material. Further, the anode 22 may be an insoluble electrode or a soluble electrode.

Examples of the conductive material constituting the anode 22 include (1) metal oxides such as indium tin oxide (ITO), indium zinc oxide, indium oxide, tin oxide, iridium oxide, osmium oxide, ferrite, and platinum oxide; (2) non-oxides such as graphite and doped silicon; (3) metals such as copper, iron, nickel, beryllium, aluminum, zinc, indium, silver, gold, platinum, tin, zirconium, tantalum, titanium, lead, magnesium, and manganese; and (4) alloys containing two or more metals such as stainless steel.

As the conductive material constituting the anode 22 or the surface thereof, platinum, gold, iridium oxide, DSA (trade name: Dimension Stable Anode, manufactured by Permelec Electrode Ltd.), a ferrite electrode, or a graphite electrode is preferably used from the viewpoint of oxidation resistance. As the conductive material constituting the anode 22 or the surface thereof, platinum or iridium oxide is more preferably used.

When a conductive thin film is formed on a surface of a base material of the anode 22, it is preferable that the thickness of the conductive thin film is selected to be optimum for the material thereof. For example, when the conductive thin film is formed of a metal oxide, the thickness thereof is preferably 0.1 μm to 5 μm and more preferably 0.5 μm to 1 μm. In addition, when the conductive thin film is formed of a metal or an alloy, the thickness thereof is preferably 5 μm to 1000 μm and more preferably 10 μm to 100 μm.

The size and shape of the anode 22 are not particularly limited, and the optimum ones according to the purpose can be selected. The anode 22 may be dense or porous. As described below, the electroplating cell 10 according to the invention can be used in a state where the cathode chamber solution 24 is not substantially present, that is, in a state where the separator 16 and the cathode 26 are in close contact with each other. In this case, when one having a predetermined pattern shape is used as the anode 22, and when electrodeposition is performed in a state where the anode 22 and the separator 16 are in close contact with each other, the shape of the anode 22 can be transferred to the cathode 26, that is, the metal coating 28 having the same shape as that of the pattern shape of the anode 22 can be formed. The metal pattern which can be formed according to the invention is not particularly limited as long as it has a shape in which a current can flow. Examples of the metal pattern include a mesh pattern, a rectangular pattern, a comb-shaped pattern, and various electric circuit patterns.

[1.4. Cathode Chamber]

In the cathode chamber 14, the cathode chamber solution 24 is stored. The size and shape of the cathode chamber 14, the material constituting the cathode chamber 14, and the like are not particularly limited, and the optimum ones according to the purpose can be selected. The cathode chamber 14 and the cathode chamber solution 24 are not essential and are not necessarily provided.

[1.5. Cathode Chamber Solution]

The cathode chamber 14 is filled with the cathode chamber solution 24 having a predetermined composition. The details of the cathode chamber solution 24 will be described below. The amount of the cathode chamber solution 24 filling the cathode chamber 14 is not particularly limited, and the optimum amount according to the purpose can be selected.

[1.6. Cathode]

The cathode 26 is a plated object. The cathode 26 is not particularly limited as long as at least a surface thereof is formed of a conductive material. The entire portion or only a surface of the cathode 26 may be formed of a conductive material.

Since specific examples of the conductive material constituting the cathode 26 are the same as those of the anode 22, the description thereof will not be repeated. In addition, when a conductive thin film is formed on a surface of a base material of the cathode 26, the preferable thickness of the conductive thin film is the same as in the description of the anode 22, and thus the description thereof will not be repeated. As the conductive material constituting the cathode 26 or the surface thereof, ITO, tin oxide, copper, or aluminum is preferably used, and ITO, tin oxide, or copper is more preferably used from the viewpoint of the material cost.

[1.7. Separator]

The separator 16 separates the cathode (plated object) 26 from the anode chamber 12. In the case of the electroplating cell 10 including the cathode chamber 14, the separator 16 is provided at a boundary between the anode chamber 12 and the cathode chamber 14. On the other hand, when the cathode chamber 14 is not present, the separator 16 is provided in contact with the surface of the cathode 26.

In the embodiment of the present invention, the separator 26 undergoes a modification treatment of introducing a carboxylic acid group or a derivative thereof into a base material. In addition, the separator 26 selectively allows permeation of metal ions contained in the anode chamber solution 20. This point is different from the related techniques. Here, "the separator 26 selectively allows permeation of metal ions" refers to a state where, during application of an electric field, the metal ions contained in the separator 16 moves in a direction from the anode chamber 12 to the cathode chamber 14, and an ion which is present as a counter ion cannot move. In addition to the carboxylic acid group and the derivative thereof, the separator 16 may further contain metal ions constituting the metal coating 28.

[1.7.1. Material of Separator]

The requirements for the separator 16 or the base material are shown in, for example, the following (1) to (4):

(1) When a voltage is applied to the metal ions contained in the anode chamber solution 20, the base material allows the metal ions to move from the anode chamber 12 to the cathode chamber 14 (or the surface of the cathode 26);

(2) The base material is non-electronically conductive (the metal coating is not deposited on the separator 16);

(3) The base material is stable in a plating bath (the base material is insoluble in the anode chamber solution 20 or the cathode chamber solution 24 and maintains a sufficient mechanical strength); and (4) When a soluble anode is used as the anode 22, the base material can prevent diffusion of fine particles (anode sludge) produced from the soluble anode to the cathode chamber 14 (can function as an anode bag).

Specific examples of the base material of the separator 16 satisfying these requirements include:

(1) a microporous membrane having continuous pores with a size (average pore size of 100 μm or less) that selectively allows permeation of the metal ions; and (2) a solid electrolyte membrane having ion permeability.

As the base material of the separator 16, a solid electrolyte membrane is preferably used, and a cation exchange membrane is more preferably used. The base material of the separator 16 may be an organic material or an inorganic material as long as it satisfies the above-described requirements.

[A. Specific Example of Microporous Membrane]

Examples of the microporous membrane formed of an organic material include:

(1) a microporous membrane formed of an organic polymer such as cellulose, polyethylene, polypropylene, polyester, polyketone, polycarbonate, polyterpene, polyepoxy, polyacetal, polyamide, polyimide, polyglycolic acid, polylactic acid, or polyvinylidene chloride; and (2) a microporous membrane formed of a solid polymer electrolyte such as an acrylic resin, a carboxyl group-containing polyester resin, a carboxyl group-containing polyamide resin, a polyamic acid resin, a polyether sulfonic acid resin, or a polystyrene sulfonic acid resin.

The organic microporous membrane may be formed of one organic material alone or two or more organic materials. In addition, the microporous membrane containing two or more organic materials may be a laminated membrane in which two or more resin membranes are bonded to each other, or may be a complex membrane in which two or more resins are polymer-alloyed.

Examples of the microporous membrane formed of an inorganic material include:

(1) an inorganic ceramic filter such as alumina, zirconia, or silica;

(2) a porous glass; and (3) an organic/inorganic hybrid membrane in which alumina, silica, or the like is dispersed in a porous membrane formed of a polyolefin such as polyethylene or polypropylene.

The pore size of the microporous membrane is necessarily a size that selectively allows permeation of the metal ions. Examples of microporous membrane that selectively allows permeation of the metal ions include:

(1) ultrafiltration membranes UF having a pore size of 0.001 μm to 0.01 μm; and (2) microfiltration membranes MF having a pore size of 0.05 μm to 10 μm.

A reverse osmosis membrane RO having a pore size of 0.002 μm or less is not suitable for the separator 16 due to its excessively high ion permeation inhibition ratio.

The microporous membrane may be either non-woven fabric or woven fabric, and may be formed of a nanofiber produced by electrospinning. In addition, the microporous membrane may be (1) a membrane obtained by melting an organic polymer and extruding and drawing the molten organic polymer; or (2) a membrane obtained by a "cast method" including the steps of dissolving an organic polymer in a solvent, coating a PET base material or the like with the solution, and volatilizing the solvent from the coating.

Further, the microporous membrane may be an inorganic porous ceramic.

These microporous membranes may be optionally subjected to the following treatments:

(1) a rubber elastic body may be bonded thereto to reinforce the mechanical strength;

(2) a net-like porous body may be provided as a core to reinforce the mechanical strength; and (3) a pattern may be formed on an ion conductive portion by coating a part of a surface of the ion conductive portion with an insulating coating body.

[B. Specific Examples of Solid Electrolyte Membrane]

The base material of the separator 16 may be a solid electrolyte membrane. When the metal ions to be electrodeposited are cations, and when a solid electrolyte membrane is used as the base material of the separator 16, it is preferable that the base material of the separator 16 is a cation exchange membrane having a cation exchange group (for example, a carboxyl group, a sulfonic acid group, or a phosphonic acid group). On the other hand, when the metal ions to be electrodeposited are anions (for example, oxyacid anions such as zincate ions or stannate ions, or a cyanide ion complex), and when a solid electrolyte membrane is used as the base material of the separator 16, it is preferable that the base material of the separator 16 is an anion exchange membrane having an anion exchange group (for example, a quaternary ammonium group).

Examples of a cation exchange resin include:

(1) a carboxyl group-containing resin such as a carboxyl group-containing acrylic resin, a carboxyl group-containing polyester resin, a carboxyl group-containing polyamide resin, or a polyamic acid resin;

(2) a sulfonic acid group-containing resin such as a perfluorosulfonic acid resin; and (3) a phosphonic acid group-containing resin.

From the viewpoints of heat resistance, chemical resistance, and mechanical strength, as the cation exchange membrane, a fluorinated cation exchange membrane is preferably used, and a perfluorosulfonic acid resin membrane is more preferably used. In addition, the above-described cation exchange resins may be used alone or in a combination of two or more kinds.

[C. Advantageous Effect of Solid Electrolyte Membrane]

Hereinafter, the reason why the solid electrolyte membrane is more preferable as the base material of the separator 16 will be described. This is because, in principle, when the solid electrolyte membrane is used, high-speed plating can be performed as compared to a case where a neutral separator (microporous membrane) is used.

A limiting current density $I_L$ (maximum electrodeposition speed) is expressed by equation (1) based on a diffusion constant D of the metal ions, a valence z, an electrodeposited ion concentration C, a diffusion thickness δ on an electrodeposited surface, and an electrodeposited ion transport number α ("Regarding limiting current density of Nickel Plating", Metal Surface Technique 1, Shigeo HOSHINO et al., vol. 23, No. 5, 1972, p. 263).

$$I_L = DzFC/(\delta(1-\alpha)) \quad (1)$$

It can be seen from equation (1) that, for high-speed plating, it is efficient to increase the electrodeposited ion transport number α to be as high as possible. In electroplating using the neutral separator (microporous membrane), the metal ion transport number α in the separator is around 0.5. On the other hand, the ion transport number is high in the solid electrolyte membrane, and α is approximately 1 in the cation exchange membrane. Therefore, it can be understood from equation (1) that a high limiting current density $I_L$ can be obtained.

However, ions having an cc value of far less than 1 are present in the solid electrolyte. In this case, ions which should not be moved as counter ions permeate through the membrane and are leaked. For example, in a case where pure water and the anode chamber solution are separated by interposing a cation exchange membrane as the separator therebetween, even when an external electric field is not present, anions are slowly leaked from the anode chamber solution to the pure water side. In particular, a hydroxide ion $OH^-$ among the anions has a significantly higher diffusion rate and is more likely to be leaked than the other anions. In addition, the amount of $OH^-$ leaked increases when the pH of the anode chamber solution is high and it is left to stand at a high temperature for a long period of time. This result implies that, when electrodeposition is performed in the anode chamber solution having high pH at a high temperature for a long period of time, a metal hydroxide is likely to be precipitated on the cathode.

When α<1 as described above, cations as counter ions of the anions are leaked to an electrodepo sited surface so as to maintain electrical neutrality. For example, an alkali metal ion such as $Na^+$ or $K^+$ which is commonly contained in the anode chamber solution as a buffer component or an impurity component has a small hydrated ionic radius and a high diffusion rate in the membrane and thus is likely to be leaked as a counter ion of $OH^-$. That is, it can be understood that, when the metal ion transport number in the separator decreases in a state where the anode chamber solution and the separator contain the alkali metal ion component, alkali (for example, NaOH or KOH) permeates through an electrodeposition interface, and a metal hydroxide is likely to be precipitated.

Due to the above-described reasons, it is preferable that the target ion transport number (the cation transport number when the electrodeposited ion is a cation; the anion transport number when the electrodeposited ion is an anion) in the separator is as close to 1 as possible. Hereinafter, the configuration of the embodiment of the invention will be described in more detail.

[1.7.2. Modification Treatment of Base Material]

[A. Action of Modification Treatment]

In the embodiment of the invention, the base material undergoes a modification treatment of introducing a carboxylic acid group or a derivative thereof into the base material. The modification treatment of the base material has an action of preventing the production of a metal hydroxide from metal ions. For example, it can be understood that when it is assumed that Ni is an electrodeposit and $Ni(OH)_2$ is a metal hydroxide, equilibrium of the following formulae (2) and (3) is established in the precipitation reaction.

$$Ni^{2+} + 2OH^- \Leftrightarrow Ni(OH)_2$$

$$Ksp = [Ni^{2+}].[OH^-]^2 = 5.47\times10^{-16} \quad (2)$$

$$OH^- + H^+ \Leftrightarrow H^2O$$

$$Kw = [H^+].[OH^-] = 1.0\times10^{-14} \quad (3)$$

That is, the nickel ion concentration $[Ni^{2+}]$, in which nickel ions do not precipitate as a hydroxide, and the pH are calculated based on the solubility product Ksp of the metal hydroxide and the ionic product Kw of water. As clearly seen from formula (2), in order not to produce a hydroxide, it is necessary to decrease the $Ni^{2+}$ ion concentration on an electrodeposited surface as much as possible and to decrease the $OH^-$ concentration (to increase the hydrogen ion concentration). In the embodiment of the invention, the base material of the separator undergoes the modification treatment to introduce a carboxylic acid group or a derivative thereof to the base material. Due to the carboxylic acid group or the derivative thereof, $Ni^{2+}$ ions are stabilized by complexation, the free $Ni^{2+}$ ion concentration (activity) is decreased, the equilibrium of formula (2) is biased to the left, and the separator is acidified with a functional group. Due to these effects, the precipitation of a metal hydroxide is prevented.

Examples of "the derivative of a carboxylic acid" include:

(1) a carboxylate;

(2) an carboxylic anhydride, an ester compound, an acid amide compound, or an acid imide compound that produces a carboxylic acid group when being hydrolyzed; and (3) a derivative of a polymer of (1) or (2).

These compounds can introduce a hardly-soluble compound having a carboxylic acid group into the separator through the hydrolysis reaction before electrodeposition. Alternatively, as the hydrolysis reaction gradually progresses during electrodeposition, a carboxylic acid is formed on the base material of the separator.

The reason why a smooth metal coating can be formed by performing a modification treatment of introducing a carboxylic acid group or a derivative thereof into the base material of separator is presumed to be due to the synergistic effect of the following chemical properties (1) of (3) of the carboxylic acid group.

(1) The precipitation of a metal hydroxide is prevented (due to the carboxylic acid group, a complexation stabilizing action and an acidifying action are obtained).

(2) The metal ion transport number is increased (a neutral void portion in the separator is blocked, and an acid group is introduced).

(3) The cathode reaction is prevented (due to metal adsorption on the surface, hydrogen production occurs, and an action of inhibiting the growth of coarse crystals is obtained).

In addition, due to this modification treatment, the carboxylic acid group is strongly bonded to the separator by chemical bonding. Therefore, the separator is stronger than a separator which is simply impregnated or coated with an organic compound (a monomolecular compound or a polymer) containing a carboxylic acid group or a derivative thereof. Accordingly, interlayer delamination or swelling does not occur in the separator.

In addition, optionally, using the carboxylic acid group introduced through the modification treatment, a plating additive (for example, amine, imine, ammonium, or quaternary ammonium) to be added to the anode chamber solution 20 can be fixed by ionic bonding (refer to the following formula (4)), or an amide compound can be formed (refer to the following formula (5)). That is, the plating additive can be fixed to the separator so as to prevent hydrogen production on the cathode and to function as a cathodic inhibitor for smoothing an electrodeposited surface. That is, by adding steps represented by formulae (4) and (5), a smoother metal coating is likely to be obtained as compared to a case where the carboxylic acid group is simply introduced into the separator.

$$R_3\text{—}COOH+R_2\text{—}NH_2 \rightarrow R_3COO^- \ldots NH_3^+\text{—}R_2 \quad (4)$$

$$R_1COOH+R_2\text{—}NH_2 \rightarrow R_1\text{—}CONH\text{—}R_2+H_2O \quad (5)$$

The modification treatment is particularly efficient for the base material (for example, polyethylene, polypropylene, cellulose, polyamide, or a fluororesin) having a surface on which no or substantially no carboxylic acid group is present. In addition, in the solid electrolyte membrane that does not undergo a terminal treatment, the radial resistance is low, and the modification treatment (for example, an .OH radical treatment described below) is easily performed under mild conditions. Therefore, this solid electrolyte membrane is particularly preferable as the base material of the separator.

[B. Portion that Undergoes Modification Treatment]

It is preferable that, among the surfaces of the separator, only a cathode-side surface or a surface in contact with the cathode chamber solution (portion near a cathode-side surface) undergoes the modification treatment. As a result, the production of a metal hydroxide can be prevented without inhibiting the ion conductivity of the separator. It is not preferable that the thickness of the layer to be treated is more than several tens of micrometers because the ion conductivity of the separator is decreased, and an increase in bath voltage is significant during electrodeposition. Accordingly, it is preferable that the thickness of the modified layer is within several tens of micrometers from the surface. The thickness of the modified layer is more preferably 10 μm or less and still more preferably 0.1 μm to 1 μm.

[C. Method of Modification Treatment]

Examples of a method of introducing a carboxylic acid group or a derivative thereof into the separator include:

(1) a physical method such as ultraviolet irradiation, corona discharge, a plasma treatment, electron beam irradiation, gamma ray irradiation, or β-ray irradiation; and (2) a chemical method such as an ozone treatment or an .OH radical treatment (a modification treatment using a Fenton reaction).

In addition, a method of coating the surface of the substrate with a precursor of a carboxylic acid and then converting the precursor into a carboxylic acid using the above-described methods (1) and (2) may be used. Further, the physical method and the chemical method may be combined (for example, refer to "Oxidation of Cyclo Olefin Polymer (COP) Resin", Hiroyuki Sugiura et al., surface technology, Vol. 64, No. 12, pp. 662 to 668 (2013).

[C.1. Physical Method]

Using the physical method, only a single surface of the separator in contact with a cathode electrodeposited surface can be modified. That is, by selecting treatment conditions and a treatment surface, an increase in membrane resistance or a decrease in mechanical properties caused by excessively modifying both surfaces or the inside of the separator can be prevented.

In the physical method, an excessive treatment causes damages to the separator and leads to a decrease in mechanical properties. Therefore, it is preferable that only the outermost surface is treated under as mild conditions as possible. In addition, in a treatment under conditions other than an oxygen atmosphere at the atmospheric pressure or a reduced pressure, the amount of a carboxylic acid group produced using the physical method is not sufficient. Therefore, it is preferable that a modification treatment (for example, an .OH radical treatment) using the chemical method is performed before or after performing the physical method.

[C.2. .OH Radical Treatment (Chemical Method)]

A case where a carboxylic acid group is introduced into the separator using .OH radicals and a perfluorosulfonic acid resin is used as the base material will be described in more detail. In the .OH radical treatment, a complex and expensive vacuum device or high-voltage device is not required unlike the physical method. ".OH radical treatment" refers to the treatment of (a) causing metal ions (catalyst ions) having .OH radical activity (Fenton activity) such as $Fe^{2+}$ and $Cu^{2+}$ to be adsorbed on the base material and then (b) dipping the base material in an hydrogen peroxide aqueous solution or exposing the base material to hydrogen peroxide vapor. Through the .OH radical treatment, the desorption of a sulfonic acid group and the production of a carboxylic acid group can be easily performed. A carboxylic acid group can be added by performing only (b) (for example, a hydrocarbon material). However, by performing a combination of (a) and (b), a target carboxylic acid group can be introduced into a material where the introduction of a carboxylic acid group is difficult, for example, a perfluoro material.

It is necessary that treatment conditions (for example, introduction conditions of catalytic metal ions as a pretreatment, hydrogen peroxide concentration, temperature, and time) be optimized by adjusting the kind of the base material of the separator, the thickness of the separator, and the like. For example, when a hydrocarbon electrolyte membrane is selected as a solid electrolyte membrane, the radical resistance thereof is lower than that of a perfluoro electrolyte membrane. Therefore, it is necessary that the treatment conditions be relatively mild. In addition, the catalytic metal ions in the membrane cause a decrease in the conductivity of the membrane and make an electrodeposit coarse, which may hinder electrodeposition. Accordingly, it is preferable that, after the above treatment, catalytic metal ions are removed by performing an acid washing treatment.

The amount of a sulfonic acid group decreased in the membrane can be measured by determining the quantity of $SO_4^{2-}$ ions derived from the desorbed sulfonic acid group, the $SO_4^{2-}$ ions being contained in the recovered hydrogen peroxide aqueous solution or in a solution obtained by the condensation of the hydrogen peroxide vapor which has passed through the membrane. In addition, the introduction degree of the produced carboxylic acid group can be examined by IR absorption analysis or XPS analysis of the membrane after the treatment.

[1.7.3. Metal Ions]

[A. Metal Ion Constituting Coating]

In addition to the carboxylic acid group and the derivative thereof, the separator 16 may further contain metal ions constituting the metal coating 28. Examples of a method of adding the metal ions to the separator 16 include:

(1) a method of preparing the separator 16 and impregnating the separator 16 with a solution containing the metal ions; and (2) a method of dissolving or dispersing the base material of the separator 16 and a compound containing the metal ions in a solvent, coating an appropriate surface of the base material with this solution, and removing the solvent.

As the compound for adding the metal ions to the separator 16, a water-soluble metal compound is preferably used. In addition, as the solution for adding the metal ions to the separator 16, a solvent having the same composition as that of the anode chamber solution is preferably used. The details of the water-soluble metal compound and the anode chamber solution will be described below.

[B. Other Metal Ions]

From the viewpoint of limiting $Na^+$, $K^+$, and $Cs^+$ ions in the anode chamber solution described below, the weight content of $Na^+$, $K^+$, and $Cs^+$ ions in the separator 16 is preferably 1% or less (an acid group exchange ratio of 50% or less). In general, a cation exchange membrane (Na form) in which 100% of acid groups are exchanged with alkali ions such as $Na^+$ is commercially available. However, when electrodeposition is performed using the separator 16, alkali metal ions are likely to be leaked to an electrodeposited surface and promotes the production of a metal hydroxide, which is not preferable.

Accordingly, a cation exchange membrane (H form) in which acid groups are not exchanged with $Na^+$, or a cation exchange membrane in which 50% or less of acid groups are exchanged with alkali ions is preferably used. In addition, in order to prevent the production of a metal hydroxide, it is more preferable that, before electrodeposition, the cation exchange membrane is pickled in advance with a strong acid such as sulfuric acid, nitric acid, or hydrochloric acid.

[1.7.4. Formation of Separator on Surface of Cathode]

A surface of the cathode 26 on which a metal coating should be formed may be coated with a polymer electrolyte which contains metal ions constituting the metal coating 28 to form a pattern on the surface of the cathode. In this case, the modification treatment of the polymer electrolyte may be performed before or after the formation of the pattern.

The surface of the cathode 26 can be coated with a microporous membrane or a mixture containing a solid electrolyte and metal ions using a commonly-used film forming method (or coating method). Examples of the film forming method include a dipping method, a spray coating method, a spin coating method, and a roll coating method. Even when metal ions are added as an aqueous solution of a water-soluble metal compound after coating the surface of the cathode 26 with a solid electrolyte, the same methods as described above can be used.

During coating using the dipping method, preferable conditions are as follows: 0° C. to 100° C. (preferably 5° C. to 20° C.) and a contact time of 0.01 minutes to 100 minutes (preferably 0.05 minutes to 10 minutes). After the coating, the surface of the cathode may be dried. In this case, drying conditions are as follows: a reduced pressure (for example, 0.01 atm to 1 atm), 0° C. to 100° C. (preferably 5° C. to 25° C.), and 1 minute to 100 minutes (preferably 5 minutes to 30 minutes). The thickness of the separator 16 is not particularly limited but is, for example, 0.01 μm to 200 μm and preferably 0.1 μm to 100 μm.

[1.8. Power Supply]

The power supply 30 is not particularly limited as long as a predetermined voltage can be applied between the anode 22 and the cathode 26.

[2. Method of Forming Metal Coating Using Electroplating Cell 10]

[2.1. Preparation of Anode Chamber Solution]

First, the anode chamber solution 20 containing the metal ions which are to be deposited on the cathode (plated object) 26 is prepared. In order to prepare the anode chamber solution 20, the water-soluble metal compound containing the metal ions to be deposited is dissolved in water. Optionally, the anode chamber solution 20 may further contain:

(1) a water-soluble organic solvent (for example, alcohols);

(2) a pH adjuster (a base, for example, amines such as ethylene diamine; or acids such as hydrochloric acid); and (3) a buffer (for example, an organic acid).

[2.1.1. Water-Soluble Metal Compound]

In the invention, the metal to be deposited is not particularly limited, and the optimum ones according to the purpose can be selected. Examples of the metal to be deposited include titanium, zirconium, vanadium, niobium, tantalum, chromium, molybdenum, tungsten, manganese, iron, cobalt, rhodium, iridium, nickel, tin, palladium, platinum, copper, silver, zinc, cadmium, aluminum, gallium, indium, silicon, germanium, arsenic, antimony, bismuth, selenium, and tellurium.

Among these, as the metal to be deposited, silver, copper, gold, nickel, tin, platinum, or palladium is preferably used because it can be electrodeposited in an aqueous solution, and the specific resistance of a metal coating thereof is low. In addition, in the case of Ni, typically, during electroplating, hydrogen is likely to be produced from the surface of the cathode 26, and a hydroxide is likely to be formed. However, when the invention is applied to Ni plating, the hydrogen production and the hydroxide formation can be suppressed.

Examples of the water-soluble metal compound include:

(1) a halide such as a chloride;

(2) an inorganic acid salt such as a sulfate (for example, copper sulfate or nickel sulfate) or a nitrate (for example, silver nitrate); and (3) an organic acid salt such as an acetate.

From the viewpoint of the material cost, an inorganic acid salt is preferably used. The anode chamber solution 20 may contain one water-soluble metal compound alone or a combination of two or more water-soluble metal compounds.

The concentration of the water-soluble metal compound contained in the anode chamber solution 20 is not particularly limited, and the optimum value for the kind or the like of the water-soluble metal compound is selected. The metal ion concentration in the anode chamber solution 20 is 0.001 M/L to 2 M/L and preferably 0.05 M/L to 1 M/L.

It is preferable that the anode chamber solution 20 contains no ions (for example, $Na^+$, $K^+$, and $Cs^+$) having high basicity and a small hydrated ionic radius that are likely to permeate through the separator 16. The present inventors found that, when 0.1 M/L or more of these ions are contained as a component of the anode chamber solution 20, a metal hydroxide is likely to be produced at an interface of the separator 16. That is, it is preferable that the concentration of ions (in particular, $Na^+$, $K^+$, and $Cs^+$) other than electrodeposited ions in the anode chamber solution 20 is limited to 0.1 M/L or less. On the other hand, among alkali metal ions, a $Li^+$ ion has a relatively large hydrated ionic radius and is not likely to permeate through the separator 16. Therefore, more than 0.1 M/L of $Li^+$ ion may be contained as a component of the anode chamber solution 20.

[2.1.2. pH Adjuster]

A pH adjuster is optionally added to the anode chamber solution 20. The pH of the anode chamber solution 20 is not particularly limited, and the optimum value for the kind or the like of the water-soluble metal compound is selected. When the pH is excessively low, a hydrogen evolution reaction is the main reaction in a reduction reaction on the cathode 26. Therefore, the electrodeposition efficiency is significantly decreased, which is not economical. Accordingly, the pH is preferably 1 or higher. On the other hand, when the pH is excessively high, a metal hydroxide is likely to infiltrate into an electrodeposited surface, and the smoothness is decreased. Accordingly, the pH is preferably 6 or lower.

[2.1.3. Buffer]

For the purposes such as a pH buffering action, improvement of conductivity to decrease bath voltage, or improvement of throwing powder properties, the anode chamber solution 20 may further contain a cation component other than metal ions required for electrodeposition. In this case, when an inorganic compound containing a $Li^+$ ion, which has a large hydrated ionic radius and is not likely to permeate through the separator, or a $Mg^{2+}$, $Ca^{2+}$, $Sr^{2+}$, $Ba^{2+}$, or $Al^{3+}$ ion, which has low basicity, is added to the anode chamber solution 20 instead of a compound containing $Na^+$, $K^+$, or $Cs^+$ ion, the production of a metal hydroxide is efficiently prevented. In addition, it is effective to add an organic compound containing an ion having low basicity of ammonium, amine, imine, imidazolium, pyridinium, pyrrolidinium, piperidinium, morpholinium, or the like which has low capability to produce a metal hydroxide.

However, an equilibrium relationship is established between the electrodeposited metal ion concentration in the anode chamber solution 20 and the metal ion concentration in the separator 16. Accordingly, in order to suppress a significant decrease in the metal ion transport number in the separator 16, it is preferable that the concentration of compounds of the metal ions is as low as possible. Specifically, it is preferable that the concentration of the compounds is limited to 0.1 M/L or less such that the occupancy (acid group exchange ratio) of cations of the compounds in the separator 16 (particularly, in a cation exchange membrane) is 50% or less. For example, in a cation exchange membrane containing 1 meq/g (EW=100) of acid groups, an $Na^+$ ion exchange ratio of 50% corresponds to a weight content ratio of about 1.2% in the membrane.

[2.1.4. Amount of Anode Chamber Solution]

The amount of the anode chamber solution 20 is not particularly limited, and the optimum amount according to the purpose can be selected.

[2.2. Preparation of Cathode Chamber Solution]

[2.2.1. Composition of Cathode Chamber Solution]

Next, the cathode chamber solution 24 is prepared. Since the composition of the cathode chamber solution 24 is the same as that of the anode chamber solution 20, the description thereof will not be repeated.

[2.2.2. Amount of Cathode Chamber Solution]

The amount of the cathode chamber solution 24 is not particularly limited, and the optimum amount according to the purpose can be selected. In the invention, the amount of the cathode chamber solution 24 may be small. Specifically, the amount of the cathode chamber solution 24 may be 100 $\mu L/cm^2$ or less per unit area of the cathode 26. In addition, the cathode chamber 14 and the cathode chamber solution 24 are not necessarily provided, that is, the separator 16 and the cathode 26 may be in close contact with each other.

When the cathode chamber solution 24 is not substantially present, an extremely small amount of water is transported from the separator 16 to the electrodeposited surface (surface of the cathode 26) by electroendosmosis. Therefore, a continuous interface is formed between the separator 16 and the cathode 26, and an electrochemical reaction (electrodeposition) can be performed. In order to improve the adhesion between the separator 16 and the surface of the cathode 26, optionally, it is preferable that electrodeposition is performed in a state where both the separator 16 and the surface of the cathode 26 are pressurized using a pressurization mechanism.

A method of electrodepositing metal in an aqueous solution with high speed using an electroplating cell is not known, in which the cathode chamber solution 24 is not substantially present and the separator 16 is used in the electroplating cell; and hydrogen production is likely to occur in the metal. When the metal is electrodeposited in a state where the cathode chamber solution 24 is not substantially present, the shape of the anode can be transferred to the plated object, and a metal pattern can be formed without masking. In addition, since the cathode chamber solution 24 is not present, the adhesion or extraction of the plating solution to the plated object can be removed, and the washing step and the waste liquid treatment step after electrodeposition can be significantly simplified.

[2.3. Electrodeposition]

The anode chamber solution 20 and the cathode chamber solution 24 are added to the anode chamber 12 and the cathode chamber 14 in predetermined amounts, respectively. Next, using the power supply 30, a voltage is applied between the anode 22 and the cathode 26 with the separator 16 interposed between the anode 22 and the cathode 26. As a result, the metal ions in the cathode chamber solution 24 are reduced, and the metal coating 28 is deposited on the cathode 26. When the deposition of the metal coating 28 progresses, the metal ion concentration of the cathode chamber solution 24 decreases. As a result, a metal ion concentration gradient is generated between the cathode chamber solution 24 and the anode chamber solution 20. By this concentration gradient functioning as a driving force, the metal ions in the anode chamber solution 20 are diffused to the cathode chamber solution 24 through the separator 16.

The voltage applied between the electrodes, the temperature of the plating bath during electrodeposition, and the electrodeposition time are not particularly limited, and the optimum values according to the purpose can be selected. For example, in the case of nickel plating, the voltage is preferably 0.01 V to 100 V and more preferably 0.05 V to 10 V. The temperature of the plating bath is preferably 0° C. to 100° C. and more preferably 10° C. to 25° C. Further, the electrodeposition time is preferably 0.01 minutes to 100 minutes and more preferably 0.05 minutes to 5 minutes.

[3. Electroplating Cell 40]

An electroplating cell according to a second embodiment of the invention includes: an anode chamber in which an anode chamber solution is stored; and a separator that separates the anode chamber and a cathode from each other. In addition, a base material of the separator undergoes the modification treatment, and the separator selectively allows permeation of metal ions contained in the anode chamber solution. That is, the electroplating cell according to the embodiment does not include a cathode chamber in which a cathode chamber solution is stored. From this point of view, the second embodiment is different from the first embodiment.

Figure 2A:
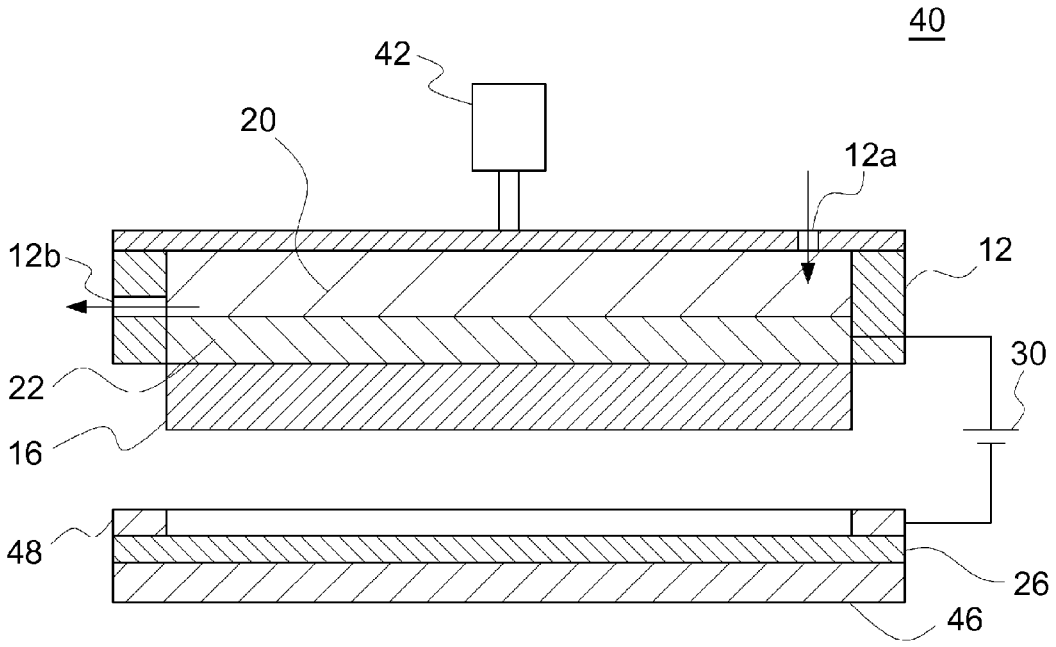
FIGS. 2A and 2B are schematic diagrams illustrating an electroplating cell according to a second embodiment of the invention.
Figure 2B:
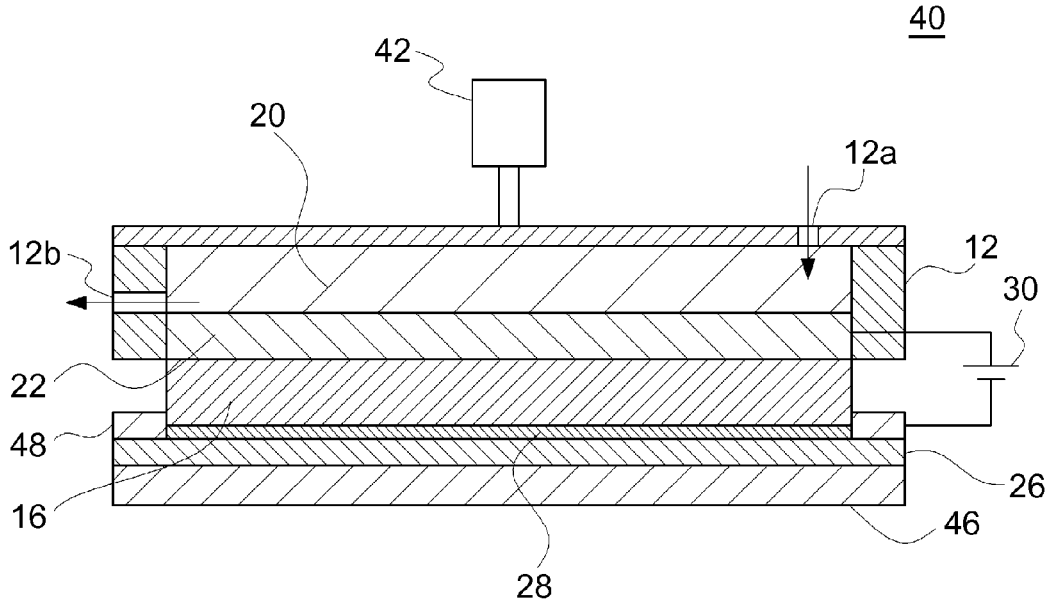

FIGS. 2A and 2B are schematic diagrams illustrating the electroplating cell according to the second embodiment of the invention. In FIGS. 2A and 2B, the electroplating cell 40 includes the anode chamber 12, the separator 16, the anode 22, the cathode 26, the power supply 30, and a pressurizing device 42.

In the anode chamber 12, the anode chamber solution 20 is stored. A supply hole 12*a* is provided on an upper portion of the anode chamber 12 to supply the anode chamber solution 20 from an anode chamber solution tank (not illustrated) to the inside of the anode chamber 12. In addition, a discharge hole 12*b* is provided on a side surface of the anode chamber 12 to discharge the anode chamber solution 20 from the anode chamber 12 to a waste liquid tank (not illustrated). The anode 22 is fitted to an opening of a lower end of the anode chamber 12. Further, the separator 16 is bonded to a lower surface of the anode 22. The pressurizing device 42 is provided on an upper surface of the anode chamber 12. The pressurizing device 42 is provided to move the anode chamber 12, the anode 22, and the separator 16 in the vertical direction.

A base 46 is disposed below the anode chamber 12. The cathode (plated object) 26 is disposed on an upper surface of the base 46. A current carrying portion 48 is provided on an outer periphery of an upper surface of the cathode 26. The current carrying portion 48 is provided to apply a voltage to the cathode 26 and surrounds a membrane-forming region of the surface of the cathode 26. As illustrated in FIGS. 2A and 2B, the current carrying portion 48 has a ring shape, and a tip end portion of the separator 16 can be inserted to this ring shape. Further, the anode 22 and the current carrying portion 48 (that is, the cathode 26) is connected to the power supply 30.

In the embodiment, as the anode 22, an electrode that allows the supply of the anode chamber solution 20 to the surface of the separator 16 is used. Specific examples of the anode 22 include a porous electrode having a pore size and a pattern electrode having a predetermined shape pattern that selectively allows permeation of the anode chamber solution 20. When the metal coating 28 is not continuously formed, a gap present inside the anode 22 can be used as the anode chamber, that is, the anode 22 can be impregnated with a necessary amount of the anode chamber solution, and the anode chamber 12 may not be substantially provided. Since the other points regarding the anode chamber 12, the separator 16, the anode 22, the cathode 26, and the power supply 30 are the same as those of the first embodiment, the description thereof will not be repeated.

[4. Method of Forming Metal Coating Using Electroplating Cell 40]

First, as illustrated in FIG. 2A, in a state where the base 46 and the separator 16 are separated from each other, the cathode 26 is disposed on the base 46, and the current carrying portion 48 is disposed around the cathode 26. In addition, the anode chamber solution 20 is supplied into the anode chamber 12 through the supply hole 12*a*. The anode chamber solution 20 is supplied to the surface of the separator 16 through a gap (not illustrated) inside the anode 22. Next, as illustrated in FIG. 2B, the anode chamber 12 is moved down using the pressurizing device 42, and a lower surface of the separator 16 is brought into contact with the upper surface of the cathode 26. At this time, a pressure force of the pressurizing device 42 is adjusted such that an appropriate pressure is applied to an interface between the separator 16 and the cathode 26.

In this state, when a predetermined voltage is applied to the anode 22 and the current carrying portion 48 (that is, the cathode 26) using the power supply 30, the metal coating 28 is deposited on the interface between the separator 16 and the cathode 26. At this time, optionally, when the new anode chamber solution 20 is supplied to the inside of the anode chamber 12 through the supply hole 12*a* while discharging the consumed anode chamber solution 20 out from the discharge hole 12*b*, continuous plating can be performed. After a predetermined time, the anode chamber 12 is moved up using the pressurizing device 42 such that the separator 16 and the cathode 26 are separated from each other.

[5. Effects]

On the surface of the cathode, a deposition reaction of metal ions (for example, $Ni^{2+}+2e^{-}\rightarrow Ni$) competes with a hydrogen evolution reaction ($2H^{+}+2e^{-}\rightarrow H_2$). On the other hand, in the aqueous solution, electrolytic dissociation equilibrium ($H_2O\Leftrightarrow H^{+}+OH^{-}$) is established between hydrogen ions and hydroxide ions. Therefore, when a hydrogen generation reaction occurs on the surface of the cathode, the $OH^{-}$ concentration in the vicinity of the cathode increases, a deposition reaction of a hydroxide (for example, $Ni^{2+}+2OH^{-}\rightarrow Ni(OH)_2$) is likely to progress. On the other hand, when the metal ion concentration in the plating solution is decreased in order to prevent the deposition reaction of a hydroxide, the deposition rate of a metal coating is decreased.

On the other hand, the separator undergoes a modification treatment of introducing a carboxylic acid group or a derivative thereof to a base material. Therefore, even when a plating solution is used containing metal ions in which hydrogen production is likely to occur, a pattern can be electrodeposited without masking. In addition, in order to prevent the deposition of a hydroxide, it is not necessary to decrease the metal ion concentration in the plating solution. Therefore, a metal coating can be formed at a high rate.

The reason is considered to be as follows.

(1) The precipitation of a metal hydroxide is prevented (due to the carboxylic acid group, a complexation stabilizing action and an acidifying action are obtained).

(2) The metal ion transport number is increased (a neutral void portion in the separator is blocked, and an acid group is introduced).

(3) The cathode reaction is prevented (due to metal adsorption on the surface, hydrogen production occurs, and an action of inhibiting the growth of coarse crystals is obtained).

Example 1, Comparative Example 1

[1. .OH Radical Treatment of Separator]

Plural perfluorosulfonic acid membranes (size: 30 mm×30 mm, thickness: 183 μm) were prepared. Using a ferrous sulfate solution, a sulfonic acid group in each membrane was exchanged with 600 ppm of $Fe^{2+}$ ions in terms of wt %. This membrane was exposed to vapor (temperature: 110° C., hydrogen peroxide concentration: 3 wt %) for 5 hours (.OH radical treatment). The exposed membrane was dipped in 1 M/L of a sulfuric acid aqueous solution for 2 hours. Next, the membrane was repeatedly washed in pure water at 80° C. to remove $Fe^{2+}$ ions and a sulfuric acid residue introduced into the membrane. After the treatment, the separator (H form) was held in ultrapure water. Next, the treated membrane was dipped in 1 M/L of NaOH at 60° C. for 2 hours. Next, the membrane was repeatedly washed in pure water at 60° C. As a result a separator (Na form) whose acid group was exchanged with $Na^+$ was obtained (Example 1). In addition, a perfluorosulfonic acid membrane (Na form) was prepared by the same procedure as that of Example 1, except that the .OH radical treatment was not performed (Comparative Example 1).

[2. Test Method]

[2.1. Attenuated Total Reflection Infrared Spectroscopy (ATR-IR)]

The Na form was analyzed by attenuated total reflection infrared spectroscopy (ATR-IR).

[2.2. Ni Plating Test]

Using the electroplating cells illustrated in FIGS. 2A and 2B, Ni plating was performed. In order to prepare an anode chamber solution, 0.5 M/L of acetic acid was added to 1 M/L of $NiSO_4$, and the pH of the obtained solution was adjusted to 5.6 using a NaOH aqueous solution. An Au-plated aluminum plate was used as the cathode 26, and a Pt/Ti porous material was used as the anode 22. The separator (H form) 16 was interposed between the cathode 26 and the anode 22. In this state, electrodeposition was performed. The electrodeposited surface area was 1 $cm^2$, the temperature was room temperature, and the current density was 20 $mA/cm^2$.

[3. Result]

[3.1. Attenuated Total Reflection Infrared Spectroscopy (ATR-IR)]

Figure 3:
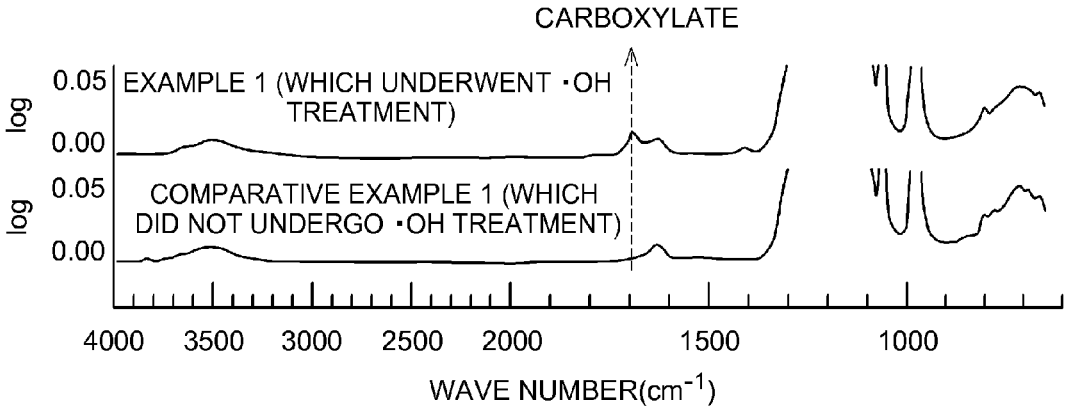
FIG. 3 is an IR absorption profile of separators (Na forms) obtained in Example 1 and Comparative Example 1.

FIG. 3 is an IR absorption profile of separators (Na forms) obtained in Example 1 and Comparative Example 1. Absorption (about 1700 $cm^{-1}$) based on a carboxylic acid group was observed in Example 1, but was not observed in the membrane (Comparative Example 1) that did not undergo the .OH radical treatment.

[3.2. Ni Plating Test]

In Comparative Example 1, a green hydroxide of $Ni(OH)_2$ was produced at an interface between the membrane and the Ni coating, and electrodeposition of glossy Ni was not observed. When moisture having permeated through the electrodeposited surface due to electro-osmosis of the separator was examined with a pH-test paper, the pH was 8. On the other hand, in Example 1, after the electrodeposition, the production of a metal hydroxide was not observed at an interface between the membrane and the Ni coating, and electrodeposition of glossy Ni was observed. When moisture of the electrodeposited surface was examined with a pH-test paper, the pH was 2.5.

Example 2, Comparative Example 2

[1. .OH Radical Treatment of Separator]

The .OH radical treatment was performed on a perfluorosulfonic acid cation exchange membrane (thickness: 183 μm, size: 30 mm×30 mm) (Example 2). Treatment conditions were the same as those of Example 1, except that the time of exposure to the hydrogen peroxide vapor was changed to 2 hours. In addition, a perfluorosulfonic acid cation exchange membrane that did not undergo the .OH radical treatment was provided for the test without any change (Comparative Example 2).

[2. Test Method]

Using the electroplating cell illustrated in FIG. 1, Ni plating was performed. As the anode 22 and the cathode 26, a Pt plate (size: 2 cm×2 cm, thickness: 300 μm) was used. As the plating solution (the anode chamber solution 20 and the cathode chamber solution 24), a solution containing 1 M/L of $NiSO_4$ and 0.5 M/L of $CH_3COOH$ was used, and the pH thereof was adjusted to 5.6 using a 20 wt % NaOH solution. The NaOH concentration in the plating solution was 0.08 M/L. The amount of the anode chamber solution 20 was 35 g, the amount of the cathode chamber solution 24 was 17.5 g, and the total amount of the plating solution was 52.5 g.

The separator 16 that underwent or did not undergo the .OH radical treatment was placed in a two-chamber cell formed of vinyl chloride in which the membrane surface area at an opening was 20 mm×20 mm. Next, constant-current electrodeposition was performed at room temperature at 200 $mA/cm^2$ for 30 minutes. As the power supply 30, a DC constant current power supply having an upper limit voltage of 70 V was used. The electrodeposition was performed in both the chambers without stirring.

After the electrodeposition, the $Ni^{2+}$ concentration was measured in the anode chamber solution 20 and the cathode chamber solution 24. In the measurement, a handy absorption spectrometer (DIGITALPACKTEST (trade name; DPM-NiD), manufactured by KYORITSU CHEMICAL-CHECK Lab., Corp.) was used. A concentration ratio C ($Ni^{2+}$ concentration in the cathode chamber solution 24/$Ni^{2+}$ concentration in the anode chamber solution 20) was calculated as a reference of the $Ni^{2+}$ transport number. C value being high represents that the $Ni^{2+}$ transport number in the separator 16 is high and is advantageous for increasing the plating rate.

[3. Result]

In the case of the non-treated membrane (Comparative Example 2), the $Ni^{2+}$ concentration ratio C was 0.82. On the other hand, in the case of the membrane (Example 2) that underwent the .OH radical treatment, the $Ni^{2+}$ concentration ratio C was 0.87 which is higher than that of the non-treated membrane. This results shows that the $Ni^{2+}$ transport number was increased due to the .OH radical treatment.

Examples 3 and 4, Comparative Example 3

[1. .OH Radical Treatment of Separator]

A perfluorosulfonic acid cation exchange membrane underwent the .OH radical treatment by the same procedure as that of Example 1, except that the time of exposure to the hydrogen peroxide vapor was changed to 1 hour (Example 3) or 2 hours (Example 4). In addition, a perfluorosulfonic acid cation exchange membrane that did not undergo the .OH radical treatment was provided for the test without any change (Comparative Example 3).

[2. Test Method]

In order to examine the permeation preventing state of $OH^-$ ions caused by the modification of the separator, the separator was disposed between the anode chamber solution and pure water to perform a permeation test. As the anode chamber solution, a solution containing 1 M/L of $NiSO_4$ and 0.5 M/L of $CH_3COOH$ was used, and the pH thereof was adjusted to 3.0 using a 20 wt % NaOH solution. The NaOH concentration in the anode chamber solution was 0.08 M/L.

The amount of the anode chamber solution was 35 g, the amount of pure water in the cathode chamber was 8.5 g, and the total amount of the solution was 43.5 g.

The separator was placed in a two-chamber cell formed of vinyl chloride in which the membrane surface area at an opening was 20 mm×20 mm. Next, the separator was left to stand at room temperature for 30 minutes to perform a permeation test. After the permeation test, the pH and the conductivity of the pure water side were measured. In the measurement, a compact pH meter (LAQUA twin (trade name) B-712, manufactured by Horiba, Ltd.) and a compact conductivity tester (twincond B-173, manufactured by Horiba, Ltd.) were used.

[3. Result]

The results are shown in Table 1. When Examples 3 (treated for 1 hour) and 4 (treated for 2 hours) were compared to Comparative Example 3 (not treated), both the conductivity of the pure water side and the pH were low. This result shows that: (a) due to the improvement of the cation transport number, $OH^-$ was not likely to permeate through the cathode-side surface of the separator, and an increase in the pH was suppressed; and (b) as a result, the precipitation of $Ni(OH)_2$ was prevented.

TABLE 1

| | Treatment Time (hr) | Conductivity (μS/cm) | pH |
|---|---|---|---|
| Example 3 | 1 | 520 | 4.30 |
| Example 4 | 2 | 380 | 4.27 |
| Comparative Example 3 | 0 | 620 | 4.45 |

Example 5, Comparative Example 4

[1. .OH Radical Treatment of Separator]

A perfluorosulfonic acid cation exchange membrane underwent the .OH radical treatment by the same procedure as that of Example 1, except that the time of exposure to the hydrogen peroxide vapor was changed to 2 hours (Example 5). In addition, a perfluorosulfonic acid cation exchange membrane that did not undergo the .OH radical treatment was provided for the test without any change (Comparative Example 4).

[2. Test Method]

Using the electroplating cells illustrated in FIGS. 2A and 2B, Ni plating was performed. In order to prepare an anode chamber solution, 0.5 M/L of acetic acid was added to 1 M/L of $NiSO_4$, and the pH of the obtained solution was adjusted to 5.6 using a NaOH aqueous solution. An Au-plated aluminum plate was used as the cathode 26, and a Pt/Ti porous material was used as the anode 22. The separator 16 was interposed between the cathode 26 and the anode 22. In this state, electrodeposition was performed. The electrodeposited surface area was 1 $cm^2$, the temperature was room temperature, the current density was 200 $mA/cm^2$, and the electrodeposition time was 10 minutes.

[3. Result]

In Example 5, when the amount ΔW of Ni electrodeposited and the electrodeposition efficiency η were obtained based on weight changes, ΔW was 8 mg, and η was 23%. The Ni coating forming rate was calculated as 0.9 μg/min. In addition, the infiltration of the Ni coating into the separator was not observed. On the other hand, in the non-treated membrane (Comparative Example 4), the infiltration of the Ni coating into the separator after the electrodeposition was observed. In addition, the production of green $Ni(OH)_2$ was observed, and favorable electrodeposition was not able to be performed. Therefore, the amount of Ni electrodeposited was not able to be calculated.

Hereinabove, the embodiments of the invention have been described in detail. However, the invention is not limited to the above-described embodiments, and various modifications can be made within a range not departing from the scope of the invention.

The electroplating cell according to the invention can be used for the formation of various metal coatings.

What is claimed is:

1. A method of forming a separator of an electroplating cell, the electroplating cell comprising an anode chamber in which an anode chamber solution is stored; and the separator, wherein the separator is configured to separate the anode chamber and a cathode, and the separator is configured to selectively allow permeation of metal ions contained in the anode chamber solution, the method comprising:

a step of undergoing a modification treatment of introducing a carboxylic acid group or a derivative thereof into a base material of a perfluorosulfonic acid resin membrane, wherein the modification treatment is an .OH radical treatment comprising:

(a) causing metal ions having .OH radical activity to be adsorbed on the base material and then (b) dipping the base material in a hydrogen peroxide aqueous solution or exposing the base material to hydrogen peroxide vapor.

2. The method according to claim 1, wherein the electroplating cell further comprises:

a cathode chamber in which a cathode chamber solution is stored, wherein the separator is provided at a boundary between the anode chamber and the cathode chamber.

3. The method according to claim 1, wherein in the separator, only a portion of the base material near a cathode-side surface undergoes the modification treatment.

4. A method of forming a metal coating comprising:

forming a metal coating on a surface of a cathode using an electroplating cell which comprises the separator manufactured by the method according to claim 1.

* * * * *